US009767679B2

(12) United States Patent
Piccolo, III et al.

(10) Patent No.: US 9,767,679 B2
(45) Date of Patent: Sep. 19, 2017

(54) METHOD AND APPARATUS FOR TESTING FIRE ALARM INITIATING DEVICES

(71) Applicant: Tyco Fire & Security GmbH, Neuhausen am Rheinfall (CH)

(72) Inventors: Joseph Piccolo, III, Fitzwilliam, NH (US); Daniel G. Farley, Westminster, MA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 236 days.

(21) Appl. No.: 14/455,024

(22) Filed: Aug. 8, 2014

(65) Prior Publication Data

US 2015/0248832 A1 Sep. 3, 2015

Related U.S. Application Data

(60) Provisional application No. 61/946,674, filed on Feb. 28, 2014.

(51) Int. Cl.
*G08B 29/00* (2006.01)
*G08B 29/14* (2006.01)

(52) U.S. Cl.
CPC ..... *G08B 29/145* (2013.01)

(58) Field of Classification Search
CPC .... G08B 25/14; G08B 29/043; G08B 29/126; G08B 29/145
See application file for complete search history.

(56) References Cited

U.S. PATENT DOCUMENTS 4,517,554 A 5/1985 Moser et al.
4,908,602 A * 3/1990 Reich ..... G08B 29/12 340/506

(Continued)

FOREIGN PATENT DOCUMENTS

EP 1 400 940 A1 3/2004
EP 2 128 834 A1 12/2009
GB 2459322 A 10/2009

OTHER PUBLICATIONS

U.S. Appl. No. 14/157,847, filed Jan. 17, 2014, entitled "Testing System and Method for Fire Alarm System," by Moffa, Anthony P.

(Continued)

*Primary Examiner* — Omeed Alizada
(74) *Attorney, Agent, or Firm* — HoustonHogle LLP

(57) ABSTRACT

According to systems and methods for testing alarm initiating devices of a fire alarm system, a control panel of the fire alarm system is placed into test mode. Then, during a walkthrough test, an inspector activates an inspector-activated mechanism of a device. This sends a test mode signal to the control panel, which places the device into a test mode. The inspector or inspector then manually activates the device. The control panel initiates a fire alarm condition in response to a received device signals while the control panel not initiating a fire alarm condition when the device signals are indicative of a fire if the device signals were from alarm initiating devices in the test mode. Alternatively, the control panel places a group of alarm initiating devices into test mode on a rolling basis. As the inspector tests the devices, additional devices are added to the group and previously tested devices are returned to normal operation mode.

26 Claims, 8 Drawing Sheets

(56) References Cited

U.S. PATENT DOCUMENTS

| | | | | |
|---|---|---|---|---|
| 5,499,012 | A | 3/1996 | Tracy et al. | |
| 5,621,394 | A | 4/1997 | Garrick et al. | |
| 5,686,885 | A * | 11/1997 | Bergman | G08B 25/10 340/506 |
| 5,898,368 | A | 4/1999 | Handley et al. | |
| 6,313,744 | B1 | 11/2001 | Capowski et al. | |
| 6,737,967 | B2 | 5/2004 | Farley | |
| 6,753,786 | B1 * | 6/2004 | Apperson | G08B 17/10 340/514 |
| 6,769,285 | B2 | 8/2004 | Schneider et al. | |
| 6,950,016 | B2 | 9/2005 | Farley | |
| 7,158,023 | B2 | 1/2007 | Kaiser | |
| 7,167,088 | B2 | 1/2007 | Farley | |
| 7,167,098 | B2 | 1/2007 | Siber et al. | |
| 7,242,288 | B2 | 7/2007 | Kaiser et al. | |
| 8,228,182 | B2 | 7/2012 | Orsini et al. | |
| 2005/0110631 | A1 * | 5/2005 | Siber | G08B 29/145 340/514 |
| 2008/0084291 | A1 * | 4/2008 | Campion | G08B 29/145 340/514 |
| 2012/0154141 | A1 | 6/2012 | Piccolo, III | |
| 2012/0286946 | A1 | 11/2012 | Karl et al. | |

OTHER PUBLICATIONS

International Search Report and Written Opinion of the International Searching Authority, mailed on Sep. 30, 2015, from counterpart International Application No. PCT/IB2015/051377, filed on Feb. 24, 2015.

International Preliminary Report on Patentability, mailed Sep. 15, 2016 from International Application No. PCT/IB2015/051377, filed Feb. 24, 2015. Twelve pages.

* cited by examiner 120,122

| Alarm Device ID | Date | Device Tested | Location | Result | Note |
|---|---|---|---|---|---|
| AD--0001 | 5-15-2014 | Smoke Detector | 1st Fl. Ladies Rm. | Pass | N/A |
| AD--0002 | 5-15-2014 | Smoke Detector | 1st Fl. Ladies Rm. | Pass | N/A |
| AD--0003 | 5-15-2014 | Pull Station | Copy Room | Pass | N/A |
| AD--0004 | 5-15-2014 | Alarm (light/horn) | Southwest Hallway | Fail | Broken Bulb |
| AD--0005 | 5-15-2014 | Temp. Sensor | Southwest Hallway | Pass | N/A |
| AD--0006 | 5-15-2014 | Temp. Sensor | Southwest Hallway | Pass | N/A |
| AD--0007 | 5-15-2014 | Smoke Detector | Main Lobby | Pass | N/A |
| AD--0008 | 5-15-2014 | Pull Station | Main Lobby | Pass | N/A |
| AD--0009 | 5-15-2014 | Smoke Detector | Elevator Lobby | Fail | Needs Cleaning |
| . | . | . | . | . | . |
| . | . | . | . | . | . |
| . | . | . | . | . | . |
| AD-9999 | 5-15-2014 | Smoke Detector | 10th Fl. Breakroom | Pass | N/A |

Fig. 4

METHOD AND APPARATUS FOR TESTING FIRE ALARM INITIATING DEVICES

RELATED APPLICATIONS

This application claims the benefit under 35 USC 119(e) of U.S. Provisional Application No. 61/946,674, filed on Feb. 28, 2014, which is incorporated herein by reference in its entirety.

BACKGROUND OF THE INVENTION

Fire alarm systems are often installed within commercial, residential, or governmental buildings. Examples of these buildings include hospitals, warehouses, schools, shopping malls, government buildings, and casinos, to list a few examples. The fire alarm systems typically include a control panel, fire alarm initiating devices, and annunciation devices. Some examples of alarm initiating devices include smoke detectors, carbon monoxide detectors, temperature sensors, and pull stations. Similarly, annunciation devices include speakers, horns, bells, chimes, light emitting diode (LED) reader boards, and/or flashing lights (e.g., strobes), to list a few examples.

The alarm initiating devices monitor the buildings for indicators of fire. Upon detection of indicators of fire, device signals are sent from the alarm initiating devices to the control panel. The device signals are typically alarm signals and/or analog values. In general, the alarm signals are generated by alarm initiating devices in the situation where the alarm initiating devices themselves determine whether ambient conditions are indicative of a fire. The alarm signals are used to signal the control panel that a fire has been detected. Alternatively, some devices provide analog values to indicate measured conditions. In one example, temperature sensors provide analog values for measured temperatures. In another example, smoke sensors provide analog values indicating smoke obscuration levels. The control panel then determines if the analog values are indicative of a fire. Additionally, in some examples, the alarm initiating devices provide both alarm signals and analog values.

In response to detection of indictors of fire, the control panel initiates an alarm condition, which often includes an evacuation of the building. Additionally, the control panel may also send a signal to a fire department, a central communications or receiving station, a local monitoring station, and/or other building alarm/notification systems (e.g., public address systems).

Typically, the alarm initiating devices are periodically tested (e.g., monthly, quarterly, or annually depending on fire or building codes) to verify that the devices are physically sound, unaltered, working properly, not obstructed, properly labeled, and located in their assigned locations. This testing of the devices is often accomplished with a walkthrough test. A typical walkthrough test includes two inspectors that work as a team to perform the test. In general, the term inspector refers to any authorized person that inspects the alarm initiating device. Additionally, some inspectors may also have additional skills sets (e.g., fire fighting, or technical skills). Thus, the inspector could be a person that only inspects the devices or the inspector could be, for example, a technician that is also able to install, configure, and/or repair alarm systems.

One inspector stays at the control panel and the other inspector moves through the building, activating each device (e.g., applying real or artificial smoke to a smoke detector). Upon activation, the devices send device signals to the control panel and the inspector at the control panel records results of the test. Additionally, the inspector at the panel watches for any unsolicited (or "real") alarms that are received by the control panel. If a "real" alarm is identified by the inspector at the control panel, the fire alarm system is restored to normal operation mode and an alarm condition is initiated (or generated) by the control panel.

Currently, procedures exist for mitigating risks of missing real alarms during walkthrough tests. The fire alarm systems can be divided into separate zones (e.g., each floor of a building) and only one zone is deactivated at a time during the test to limit the number of disabled devices in the fire alarm system. Moreover, at least one inspector remains within the deactivated zone during the test. This inspector is thus able to watch for any fires that might occur in that deactivated zone during the test.

SUMMARY OF THE INVENTION

Problems exist with these currently-used walkthrough tests. First, two inspectors are required to perform the test. Also, unfortunately, the zones are often not set-up for the fire alarm systems. This is because of the time and costs required to install, configure, and test the zones during the installation of the fire alarm systems. Additionally, depending on the size of the zones and building, the inspector may not be able to monitor the entire zone during the walkthrough test.

Recently, systems have been proposed to allow a single inspector to monitor the control panel via a mobile computing device. In this situation, the inspector carries the mobile computing device (e.g., smartphone or tablet) that communicates either directly or indirectly with the control panel. The mobile computing device enables the inspector to monitor and control the control panel. This system allows a single inspector to test the devices, monitor results of the walkthrough test, and monitor the control panel for any unsolicited (or "real") alarms.

In general, the present systems concern techniques for limiting the number of disabled devices during a walkthrough test.

In one embodiment, an inspector activates inspector-activated mechanisms (e.g., magnetically activated switches) of alarm initiating devices that are about to be tested. Activating these mechanisms generates test mode signals that are sent to the control panel to indicate that these devices should be disabled and placed into test mode by the control panel. The remaining devices are typically left in a normal operation mode. If the control panel subsequently receives device signals from the alarm initiating devices in the test mode, then the control panel does not initiate an alarm condition. This is because the activation of the inspector-activated mechanisms indicates that subsequent device signals are related to the test of the devices and are not "real" alarms. If, however, the control panel receives device signals from any of the other devices in the normal operation mode, then the control panel initiates an alarm condition.

In an alternative embodiment, the alarm initiating devices of the fire alarm system are disabled by the control panel on a "rolling" basis. As the inspector moves through the building and tests each of the devices, additional devices are added to a group of disabled devices and previously tested devices are returned to a normal operation mode. In this embodiment, the inspector moves from one device to the next while devices that need to be tested are put in test mode in advance of the inspector reaching those devices.

In general, according to one aspect, the invention features a fire alarm system. This system includes fire alarm initiating devices, each of the devices having an inspector activated mechanism. The system further includes a control panel that receives device signals from the alarm initiating devices and initiates fire alarm conditions based on the device signals. Additionally, the control panel places the alarm initiating devices into a test mode in response to the inspector-activated mechanisms being activated. Conversely, the control panel does not initiate a fire alarm condition when the device signals are indicative of a fire if the device signals were from alarm initiating devices in the test mode.

In one embodiment, the control panel returns the alarm initiating devices from the test mode to a normal operation mode in response the device signals no longer being indicative of a fire. Alternatively, the control panel forces the alarm initiating devices to return from the test mode to the normal operation mode after a predefined length of time Preferably, the alarm initiating devices provide visual and/or audible indications that the alarm initiating devices have been placed into the test mode by the control panel after the inspector-activated mechanisms are activated.

In a typical implementation, the control panel generates event data in response to the received device signals. This event data include addresses of the alarm initiating devices in the fire alarm system, dates and times of the activations of the alarm initiating devices, and/or fault states of the alarm initiating devices.

In embodiments, the inspector-activated mechanisms are magnetic switches of the alarm initiating devices.

Generally, the alarm initiating devices include smoke detectors, carbon monoxide detectors, temperature sensors, smoke obscuration sensors, and/or pull stations.

Additionally, the control panel determines if the devices are generating device signals indicative of a fire upon returning to a normal operation mode and the control panel initiating a fire alarm condition if the device signals are indicative of a fire.

In general, according to another aspect, the invention features a method of operation of a control panel of a fire alarm system. The method includes receiving device signals and indications of whether inspector-activated mechanisms were activated from alarm initiating devices. The method further includes the control panel placing the alarm initiating devices into a test mode in response to receiving indications that the inspector-activated mechanisms were activated. Additionally, the control panel does not initiates a fire alarm condition when the device signals are indicative of a fire if the device signals were from alarm initiating devices in the test mode. The control panel does initiates a fire alarm condition when the device signals are indicative of a fire if the device signals were from alarm initiating devices in a normal operation mode.

In general, according to yet another aspect, the invention features a method of testing the operation of alarm initiating devices. Typically, the method includes activating inspector-activated mechanisms of the alarm initiating devices to signal a control panel that a test is to be performed. The method includes activating the alarm initiating devices to generate device signals, which are sent to the control panel. Additionally, the control panel automatically returns the alarm initiating devices to a normal operation mode.

In general, according to still another aspect, the invention features a method for testing a fire alarm system. The method comprises disabling alarm initiating devices of the fire protection system that a control panel determines will be tested next in a sequence. Additionally, in response to the testing of the disabled alarm initiating devices, the control panel disables additional alarm initiating devices in the sequence.

In embodiments, the control panel disables the alarm initiating devices in response to an inspector indicating results of a test of a disabled device.

Typically, the control panel returns the disabled alarm initiating devices to a normal operation mode in response to device signals from the alarm initiating devices no longer being indicative of a fire.

Generally, the control panel returns the alarm initiating devices to a normal operation mode after a predefined length of time.

Preferably, the alarm initiating devices provide visual and/or audible indications that the alarm initiating devices are in a test mode.

Typically, the sequence for disabling the alarm initiating devices is based on previous tests of the alarm initiating devices of the fire alarm system. Additionally, the control panel generates a route to guide an inspector during a test of the fire alarm system, the route based on the sequence of disabled alarm initiating devices. Further, the control panel transmits the route and the sequence to the inspector to guide the inspector during the test of the alarm initiating devices.

Preferably, the alarm initiating devices includes smoke detectors, carbon monoxide detectors, temperature sensors, smoke obscuration sensors, and/or pull stations.

In general, according to another aspect, the invention features a fire alarm system that includes alarm initiating devices that monitor areas for indications of fire. Additionally, the fire alarm system includes a control panel that successively disables the alarm initiating devices in a sequence as the alarm initiating devices are tested.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings:

FIG. 4 illustrates an example of the database architecture for storing test results of the walkthrough test in the control panel database and/or a central communications database.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms and the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Figure 1:
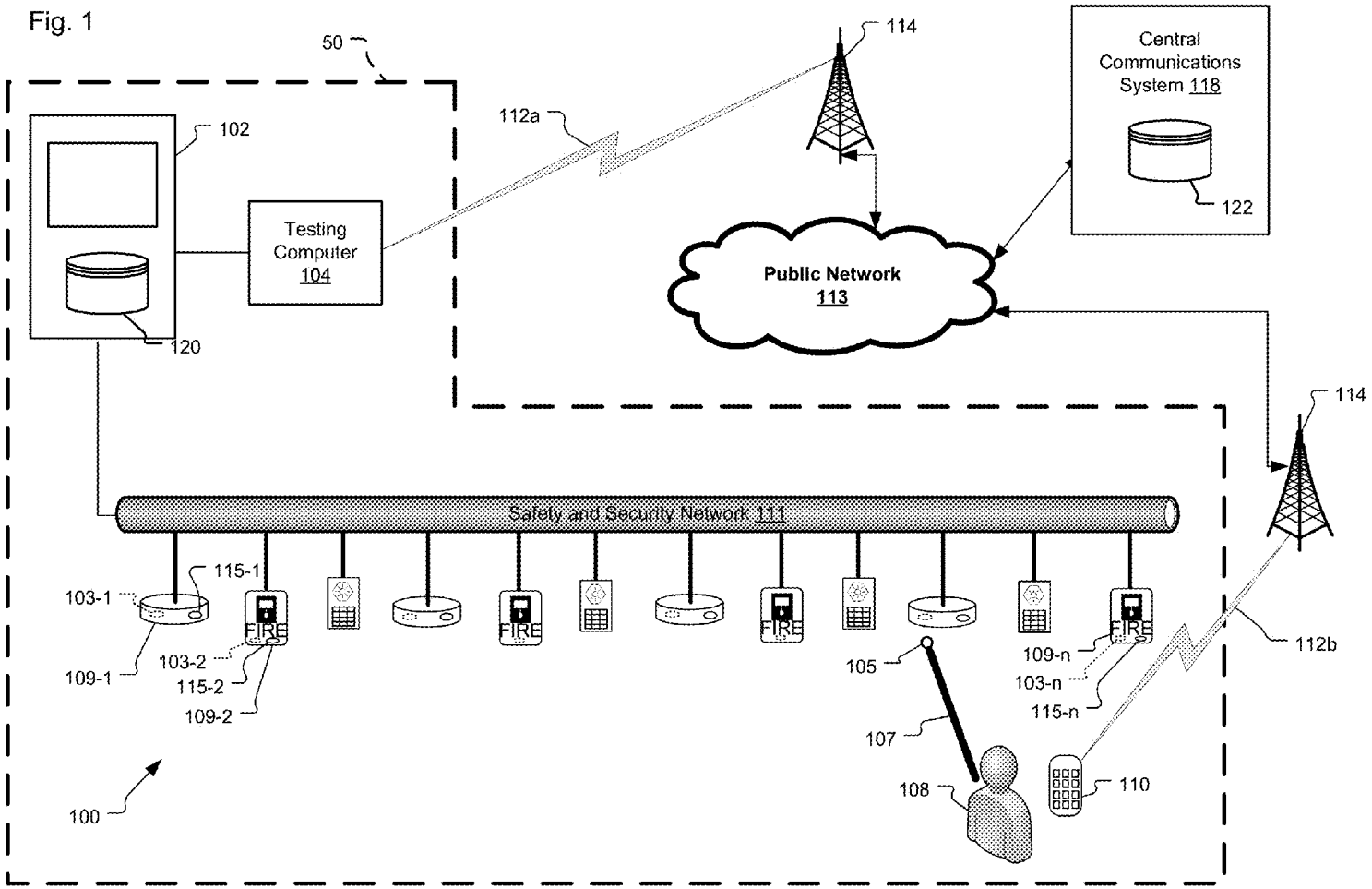
FIG. 1 is a block diagram illustrating a fire alarm system, which includes alarm initiating and annunciation devices, a control panel, and testing computer.

FIG. 1 is a block diagram illustrating a fire alarm system 100, which includes alarm initiating devices and annunciation devices 109-1 to **109-*n*, a control panel 102, and a testing computer 104**.

Generally, the fire alarm system 100 is located within and/or outside a building 50, which could be residential, commercial, or governmental. Examples of the buildings include offices, hospitals, warehouses, retail establishments, shopping malls, schools, government buildings, or casinos, to list a few examples.

In a typical implementation, the alarm initiating devices include smoke detectors, carbon monoxide detectors, temperature sensors, and manually activated devices such as pull stations. In some embodiments, the smoke detectors also provide analog values that indicate a percentage of smoke obscuration or whether the detector is obstructed. The annunciation devices generally include speakers, horns, bell, chimes, light emitting diode (LED) reader boards, and/or flashing lights (e.g., strobes), to list a few examples.

The devices 109-1 to **109-*n* and the control panel 102 are connected to a safety and security wired and/or wireless network 111 of the building 50. This network 111 supports data and/or analog communication between the devices 109-1 to 109-*n* and the control panel 102. Additionally, in some embodiments, security devices such as surveillance cameras, motion detectors, access control readers, public address systems, and/or intercom systems could also be connected to the safety and security network 111**.

In the illustrated example, the alarm initiating devices 109 include inspector-activated mechanisms 103-1 to **103-*n*. In one specific example, these inspector-activated mechanisms are magnetically actuated switches. Alternatively, the inspector-activated mechanisms could be photodiode sensors that are triggered by a laser pointer, for example. In a typical implementation, an inspector 108 places a wand 107, which includes a magnet 105 located at the end of the wand 107, near or against the detector housing adjacent to the switch 103-1 to 103-*n***.

Upon activation of the inspector-activated mechanism of one of the devices, a test mode signal is sent to the control panel 102 to indicate that the device should be placed into test mode by the control panel 102. This enables the inspector to perform a test on that device without initiating an alarm condition. The control panel 102 then logs a device ID, in one example.

Upon receiving the test mode signal from the device, the control panel 102 causes LEDs 115-1 to **115-*n*** of the device to illuminate (e.g., steady on) or pulse in a pattern to indicate that the device has been placed into test mode by the control panel. Alternatively, speakers or horns of the devices could generate audible sounds (e.g., "chirp") to indicate that the device is in test mode.

After the device is placed into test mode by the control panel, the inspector 108 tests the device. Typically, this is accomplished with a testing apparatus, which includes a hood that is placed over the device. The hood surrounds the device and the testing apparatus introduces real or artificial smoke into the hood. This artificial smoke should have the effect of activating the device into an alarm state. Once activated, the device sends a device signal to the control panel 102, which generates event data based on the received device signal. The event data are then stored to a control panel database 120 and are also sent to the testing computer 104 to be stored in a log file.

The testing computer 104 communicates with a mobile computing device 110 over wireless communication links **112*a*, 112*b*, which connect the testing computer 104 and the mobile computing device 110 to a public network (e.g., the Internet) 113. In the illustrated example, the testing computer 104 and the mobile computing device 110 are wirelessly connected to one or more cellular radio towers 114** of a mobile broadband or cellular network or public and/or private wired data networks such as an enterprise network, Wi-Max, or Wi-Fi network, for example.

In an alternative embodiment, the testing computer 104 may also be connected to a central communication system 118, which is a centralized monitoring system (or service) that acts as a repository and portal to access the event data generated by the control panel 102. This central communications system 118 includes a central communication database 122 to store a copy of the event data.

Recently, a system and method for a networked testing system that implements a cloud based infrastructure to enable communications between a control panel, a central communications system, and a mobile computing device was described in U.S. patent application Ser. No. 14/157,847, filed on Jan. 17, 2014, by Anthony P. Moffa, which application is incorporated herein by this reference in its entirety.

In the illustrated example, the mobile computing device 110 is a smartphone device. Alternatively, the mobile computing device could be a laptop computer, tablet computer, or phablet computer (i.e., a mobile device that is typically larger than a smart phone, but smaller than a tablet), to list a few examples.

Figure 2:
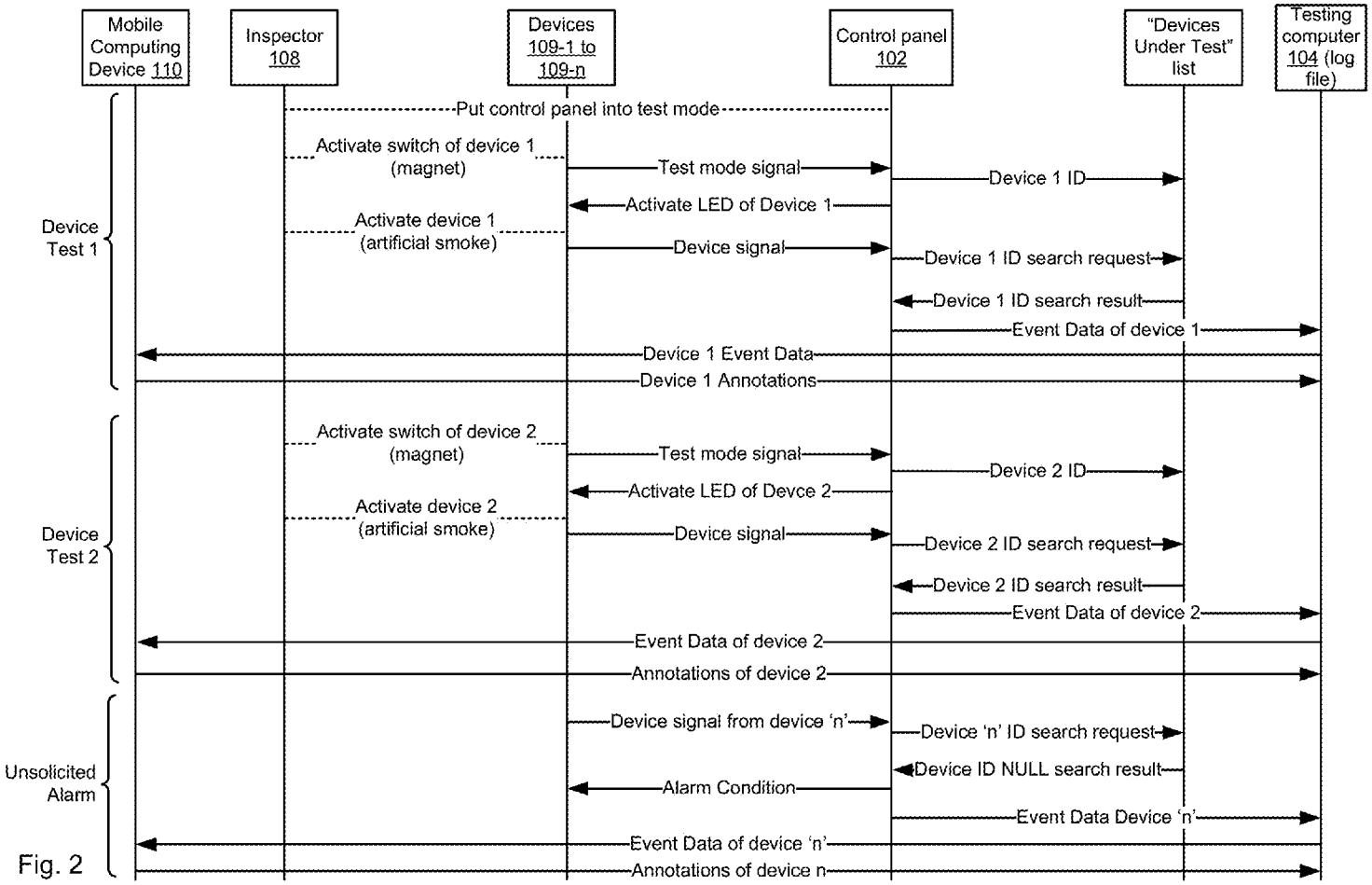
FIG. 2 is a sequence diagram illustrating the operation of the alarm initiating devices, control panel, mobile computing device, and testing computer.

FIG. 2 is a sequence diagram illustrating how the alarm initiating devices 109-1 to **109-*n*, control panel 102, mobile computing device, 110 and testing computer 104** interact during a walkthrough test.

Illustrated by way of example (labeled Device Test 1), the inspector 108 first puts the control panel 102 into test mode. Then, the inspector 108 activates the inspector-activated mechanism 103 of the device 109. This causes the device 109 to send a test mode signal to the control panel 102. The control panel 102 stores a Device ID in a "Devices Under Test" list for the device in test mode. In a current embodiment, the "Devices Under Test" list is stored in a non-volatile memory device of the control panel 102. The devices under test list could be a field in the control panel database 120 or stored as a separate data file. Alternatively, the devices under test list may be stored in a central communications database 122 of the central communications system 118 or stored in a non-volatile memory device of the testing computer 104.

After receiving the test mode signal, the control panel 102 provides an indication to the inspector 108 that the device is in test mode (e.g., illuminating an LED steady on or in pulse in a pattern). Alternatively, an audible noise could be generated to provide the indication that the device is in test mode. These audible and/or visual indications are provided for the inspector to verify that activating the devices (e.g., introducing smoke) during the test will not inadvertently initiate an alarm condition, which could lead to an evacuation of the building.

The inspector 108 then activates one of the devices 109-1 to **109-*n* by introducing real or artificial smoke to the device, in one specific example. Generally, this is done with a testing apparatus, which includes a smoke generating apparatus (e.g., a canister of artificial smoke) housed within a hood (or cup) that is attached to the end of a pole. The inspector 108** places the hood around the alarm initiating device and triggers the smoke generating apparatus to release smoke in or near the device. In alternative embodiments, in which the devices are temperature sensors or pull stations, the inspector activates the device by introducing a heat source or pulling the device's handle, respectively.

In an alternative embodiment of the testing apparatus, the magnet 105 for activating the inspector-activated mechanism is mounted to the testing apparatus. This embodiment eliminates the need for a separate wand 107 and magnet 103 and testing apparatus. When the hood of the testing apparatus is placed over the device, the magnet activates the inspector-activated mechanism to send the test mode signal. Once the inspector sees or hear the visual and/or audible indication that the device is in test mode, the inspector triggers the artificial smoke generating device to release smoke near the device.

Alternatively, or in addition, the control panel 102 could be configured to not initiate alarm conditions if the test mode signal is received within a predefined time period from when the devices signal is received. As long as the inspector-activated mechanism is activated and sends a test mode signal to the control within the specified time period, then the control panel will not initiate an alarm condition. This embodiment would allow for the inspector to essentially activate the inspector activated mechanism and test the device in a single step.

Return to the sequence of FIG. 2, the device sends a device signal to the control panel 102, which performs a search of the devices under test list. Based on the search results, the control panel 102 determines whether the device is currently on the devices under test (i.e., in test mode) to determine whether to generate an alarm condition or not.

The control panel 102 generates event data based on the received device signals. Typically, the event data include the unique identifier for the fire alarm control panel 102 and often includes information such as a physical address of the activated devices, a date and time of the activation, a fault state of the activated devices, and/or custom labels of the activated devices, to list a few examples. Additionally, the event data may include at least one analog and/or detected value such as ambient temperature, detected smoke level, a percentage of smoke obscuration, and/or detected ambient temperatures. Additionally, the analog value can also be used to determine if the device requires cleaning, is malfunctioning, or is blocked.

In the case of pull stations, the event data include whether the station has been activated or triggered. Additionally, acknowledgement and restoral times of the control panel may be included in the event data.

While the inspector-activated mechanisms and alarm initiating devices are activated by the inspector 108 during the walkthrough test, all of the event data are generated by the control panel 102. This ensures that test data cannot be manually entered, altered, or falsified.

In the illustrated example, the event data are sent to the testing computer 104 and stored in the log file of the testing computer 104. The testing computer 104 then forwards the event data to mobile computing device 110 to enable the inspector 108 to view the event data. In embodiments that include a central communications system 118, the testing computer 104 will also transmit the event data to the central communications system 118. The inspector 108 would then be able to access the event data stored the central communications system 118.

The inspector 108 may optionally apply annotations to the event data. These annotations may include a pass or fail status, images (e.g., photos taken with camera of mobile computing device), and/or voice and text messages, to list a few examples. For example, if the device appears worn or damaged, the inspector 108 would annotate the event data with notes and/or images for the damaged device. The annotated event data are then sent back to the central communications system 118 or testing computer 104. This annotated device history may be accessed later by the inspector 108 or other users that are authorized to access the event data.

These annotations are often useful for identifying or recording "failed" device tests. This is because the control panel will generally not receive device signals from the devices in a failed test. Because the control panel never receives a device signal, the control panel does record associated event data.

In an alternative embodiment, the control panel is able to infer when a device has failed a test. In this embodiment, the control panel includes a timeout period after the test mode signal is received. If no device signal is received within the timeout period, then the control records a failed device test. Alternatively, other means for identify a failed test could be implemented. For example, a second activation of the inspector-activated mechanism activation during the timeout period could signal the control panel to record that the device failed.

A second example (labeled Device Test 2) illustrates an example of a second device being placed into test mode as part of the walkthrough test. Generally, the testing process is identical to the example described with respect to device 1. Similar to the previous example, the control panel 102 receives a test mode signal followed by a device signal. Thus, the control panel 102 does not initiate an alarm condition.

FIG. 2 further illustrates an example of the operation of the control panel 102 in response to an unsolicited or "real" alarm (labeled Unsolicited Alarm). Upon receiving the device signal from device 'n', the control panel 102 determines if the device is on the devices under test list. If the device is not in the list (e.g., a NULL search result), then the control panel 102 initiates an alarm condition. The control panel 102 activates the audio and visual alarms/warnings of the annunciation devices to warn occupants of the emergency. Additionally, the control panel 102 generates event data in response to the device signal. These event data are then stored in the control panel 102 and sent to the testing computer 104. The testing computer 104 forwards the event data to the inspector 108. Additionally, the testing computer 104 may also forward the event data to the central communications system 118.

Figure 3:
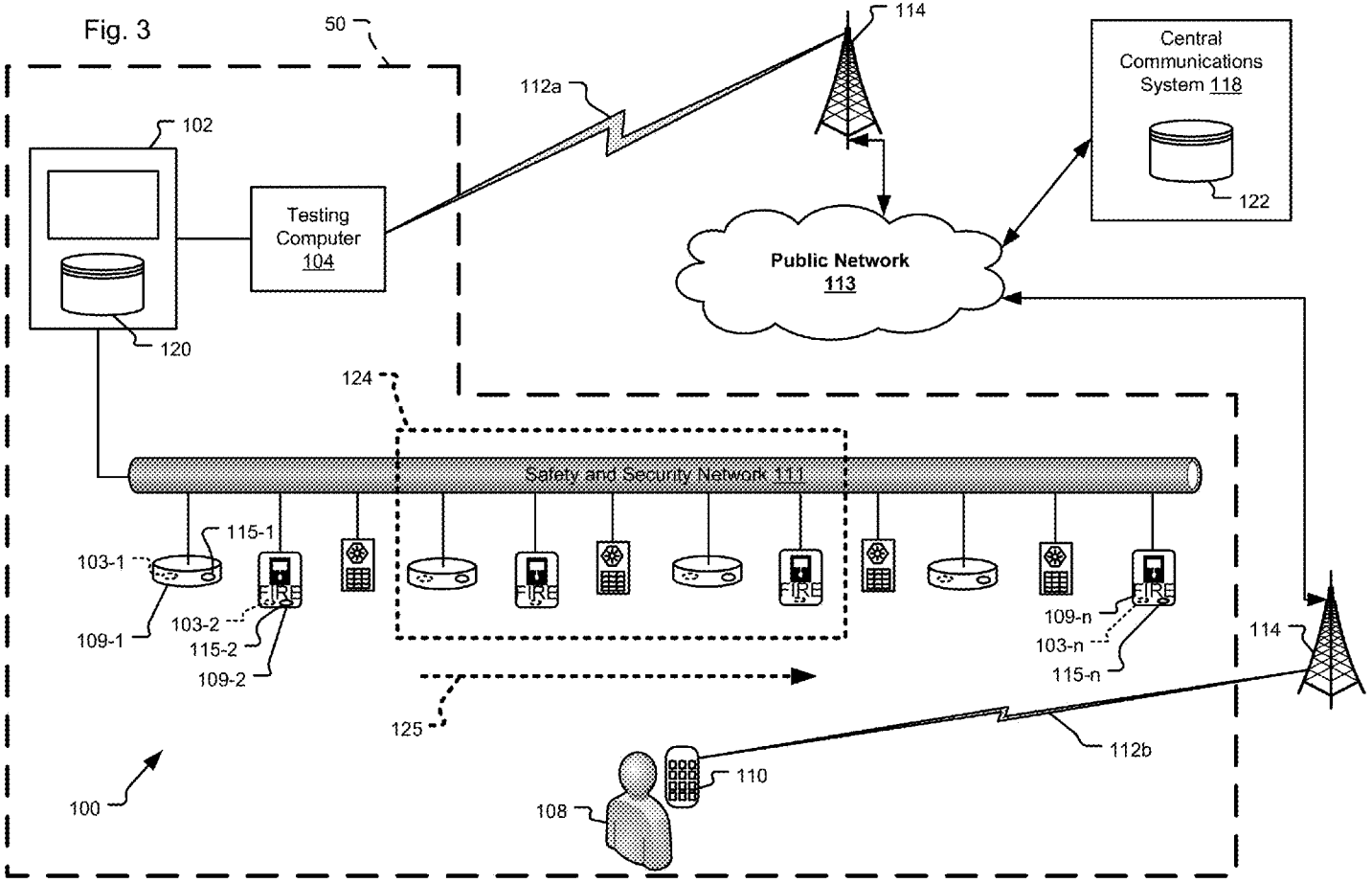
FIG. 3 is block diagram illustrating an alternative embodiment of the fire alarm system, which implements a rolling walkthrough test of the alarm initiating devices.

FIG. 3 is block diagram illustrating an alternative embodiment of the fire alarm system 100, which implements a "rolling" walkthrough test of the alarm initiating devices 103-1 to **103-*n***.

In general, the illustrated embodiment is nearly identical to the embodiment described with respect to FIG. 1. In this embodiment, however, the control panel 102 implements the rolling walkthrough test of the alarm initiating devices.

In the illustrated example, the inspector 108 does not use a wand or laser pointer to activate switches of the alarm initiating devices to signal the control panel 102 to place the devices into test mode. Instead, the control panel 102 systematically disables a group of devices 124 and the inspector 108 follows a route through the building 50 that is generated by the control panel 102. Arrow 125 shows how the group of disabled devices 124 moves through the building 50 by adding/removing the devices from the group during the rolling walkthrough test.

Similar to the embodiment described with respect to FIG. 1, the alarm initiation devices provide a visual or audible indication that the devices are disabled to help prevent the inspector from accidentally activating devices that are not in test mode.

FIG. 4 illustrates an example of the database architecture for storing test results of the walkthrough test in the control panel database 120 and/or the central communications database 122.

In the illustrated example, the control panel database 120 and/or the central communications database 122 stores the event data generated by the control panel 102 during the walkthrough test. For example, the illustrated embodiment includes fields for a device ID, a date, a device tested, a location, a test result, and inspector annotations. Additionally, the databases 120, 122 could include additional fields for an inspector ID, dates when the devices were installed (or last replaced), dates when the devices were last serviced, an address of the company/building, or a device model and serial number, to list a few examples.

Figure 5A:
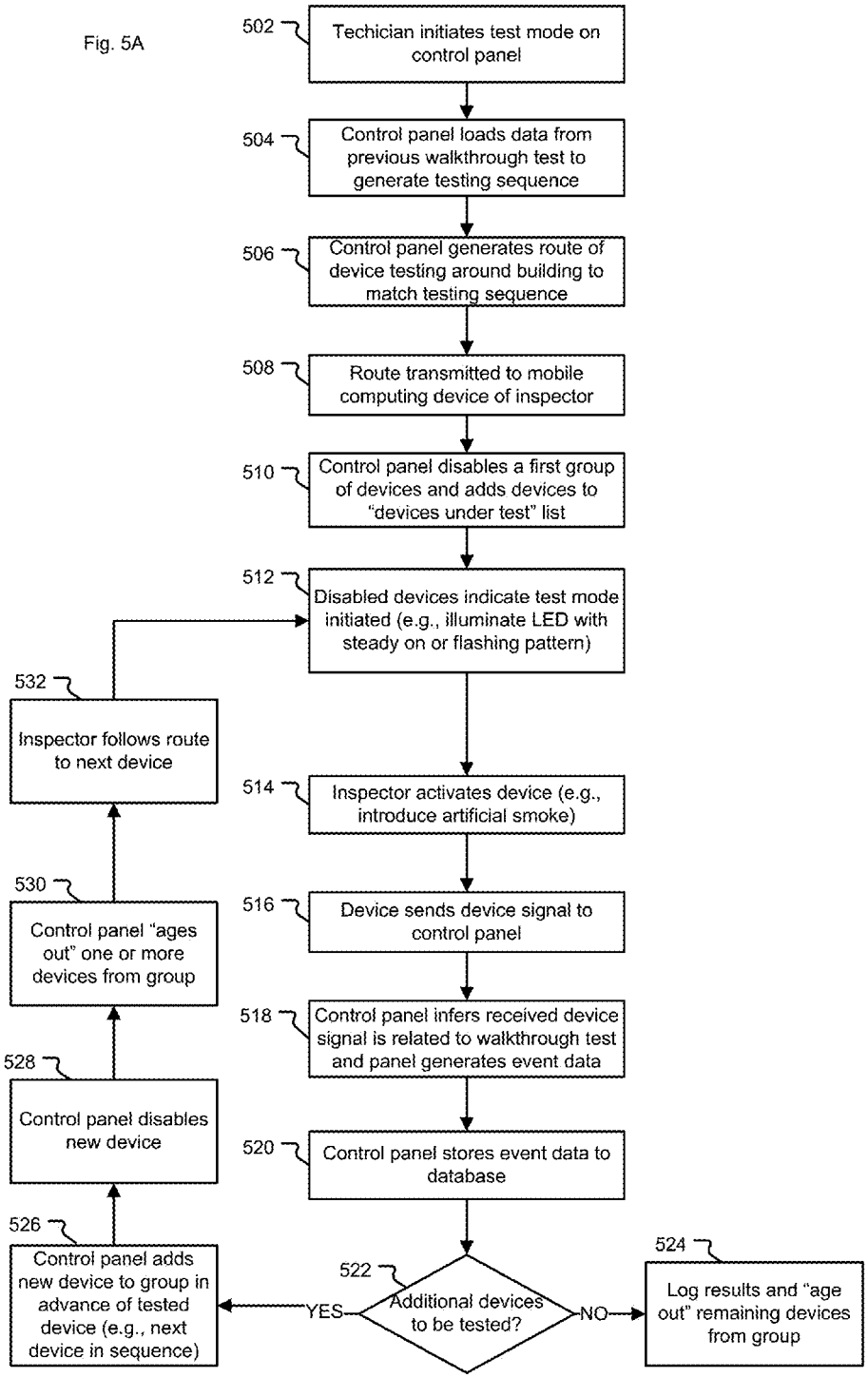
FIG. 5A is a flowchart illustrating the steps performed during a rolling walkthrough test of the alarm initiating devices.

FIG. 5A is a flowchart illustrating the steps performed during the rolling walkthrough test.

In the first step 502, the inspector 108 initiates a test mode on the control panel 102. Next, in step 504, the control panel 102 loads data from a previous walkthrough test and a preprogrammed sequence to generate a testing sequence. The control panel 102 then generates a route around the building 50 that matches (or follows) the testing sequence in step 506. The route is then transmitted to the mobile computing device 110 of the inspector 108 in step 508. In an alternative embodiment, the route is generated by an enterprise service that preloads a sequence to the control panel or tracks the inspector's progress and disables devices accordingly.

In the next step 510, the control panel 102 disables a first group of devices in the sequence and adds these devices to the devices under test list stored by the control panel. Next, in step 512, the control panel 102 sends a signal to the group of disabled devices 124 to indicate that test mode has been initiated (e.g., illuminate LED with steady on or flashing pattern) for the group of devices.

In step 514, the inspector 108 activates one of the disabled alarm initiating devices by introducing artificial smoke or pulling a handle of a pull station, for example. The alarm initiating device then sends a device signal to the control panel 102 in step 516.

The control panel 102 infers that the received device signal is related to the walkthrough test, does not initiate an alarm condition, and generates event data based on the received device signal in step 518. The alarm condition is not generated because the device signal was generated by one of the devices in the group of disabled devices (i.e., devices in test mode). Next, in step 520, the control panel 102 stores the event data to the control panel database 120. Additionally, the control panel 102 may also send the event data to the testing computer 104 and/or the central communications system 118.

In step 522, the control panel determines whether additional alarm initiating devices need to be tested. If no additional alarm initiating devices need to be tested, then the control panel 102 logs the test results in the control panel database 120 and "ages out" the remaining devices from the group in step 524. However, if additional alarm initiating devices need to be tested, then the control panel 102 adds a new device to the group in advance of tested device (e.g., next device in the sequence) in step 526 and disables the new device in step 528.

The control panel 102 then "ages out" one or more devices from the group of disabled devices in step 530. Next, in step 532, the inspector 108 follows the route to the next device in the sequence.

Figure 5B:
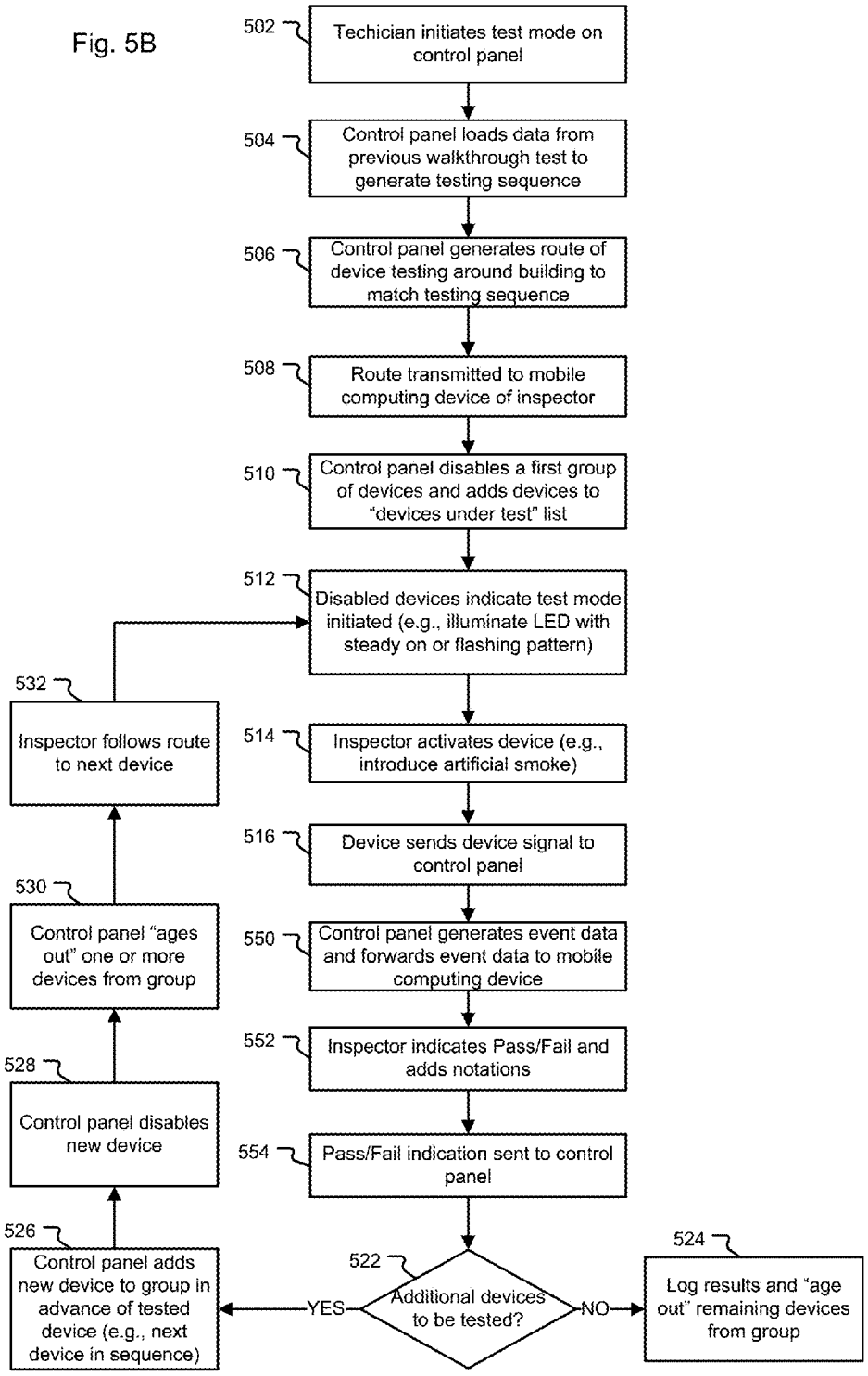
FIG. 5B is a flowchart illustrating an alternative embodiment of steps performed during the rolling walkthrough test.

FIG. 5B is a flowchart illustrating an alternative embodiment of the steps performed during the rolling walkthrough test.

In general, FIG. 5B is nearly identical to the FIG. 5A. In this embodiment, however, the inspector 108 indicates whether the alarm initiation devices passed or failed the test via the mobile computing device 110.

In more detail, steps 502 to 516 are identical to the embodiment described with respect to FIG. 5A. In step 550, the control panel 102 generates event data, which are forwarded to the mobile computing device 110. The inspector 108 then indicates whether the device passed or failed via the mobile computing device 110 and adds notations to the event data in step 552. The indication of whether the alarm initiating device passed or failed is then sent to the control panel 102 in step 554. The remaining steps, 522 to 532 are identical to the embodiment described with respect to FIG. 5A. The receipt of the pass/fail indication causes the control panel to disable another (e.g., next) device in the sequence.

Figure 6:
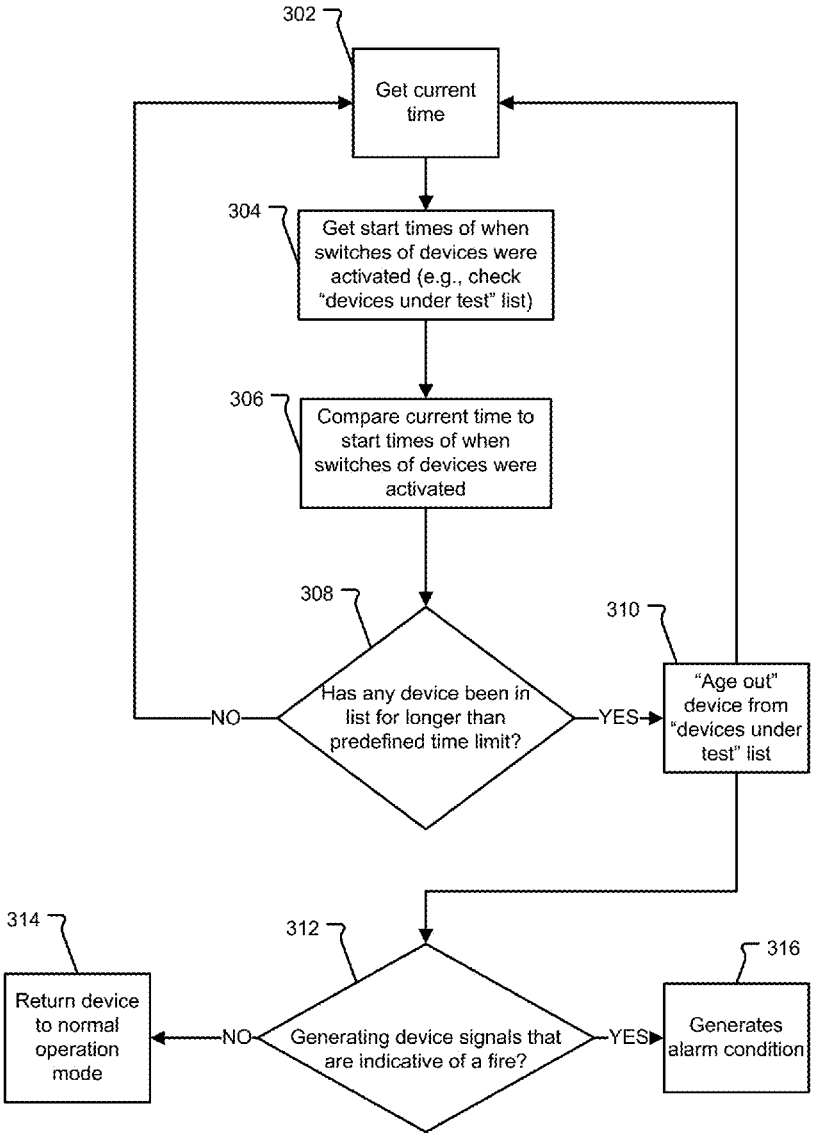
FIG. 6 is a flowchart illustrating the steps performed by the control panel to "age" the alarm initiating devices out of test mode after a predefined length of time.

FIG. 6 is a flowchart illustrating the steps performed by the control panel 102 to "age out" the devices 109-1 to **109-*n*** out of the test mode after a predetermined amount of time.

Typically, this predetermined length of time is based on the time required for the artificial smoke to flow out of a detection chamber, in the case of a smoke detector. In one specific example, the predetermined length of time is Thirty

(30) minutes, but alternative embodiments may implement longer or shorter lengths of times.

In the first step 302, the control panel 102 obtains the current time. Next, the control panel 102 obtains start times of when switches 103-1 to **103-*n* of the devices 109-1 to 109-*n* were activated (i.e., the time the alarm initiating devices were put into test mode) according to FIG. 2, or when the devices were disabled according to FIG. 5A or 5B in step 304. Typically, this time information is recorded when the alarm initiating devices 109-1 to 109-*n* were added to the devices under test list. Then, in step 306, the control panel 102** compares the current time to the start times of when the switches were activated or the devices disabled.

In step 308, the control panel 102 determines if any device has been on the list for longer than the predefined time period. If no devices have been in the list longer than the predetermined time period, such as several minutes, then the control panel 102 returns to step 302. If one or more devices have been on the devices under test list for longer than the predetermined length of time, then the alarm initiating device is aged out (i.e., removed) of the list in step 310. Then, the control panel 102 determines if any of devices removed from the devices under test are generating device signals that are indicative of a fire, in step 312. This check is performed to ensure that the devices being removed from the testing mode and returned to normal operation mode are not ignored by the control in the event of a fire occurring while the device was in test mode.

If the aged out device is generating device signal indicative of a fire, then the control panel 102 generates an alarm condition in step 316, in one example. However, if the aged out device is not generating device signals indicative of a fire, then the control panel 102 returns the alarm initiating device to normal operation mode in step 314.

In some cases, it is deemed undesirable to force devices out of test mode. As a result, in some examples, devices that are in alarm or generating analog values indicative of a fire, for example, will remain in test mode. If the device does not then return to normal levels, a device trouble condition is initiated and the device is put in a Disabled state.

Figure 7:
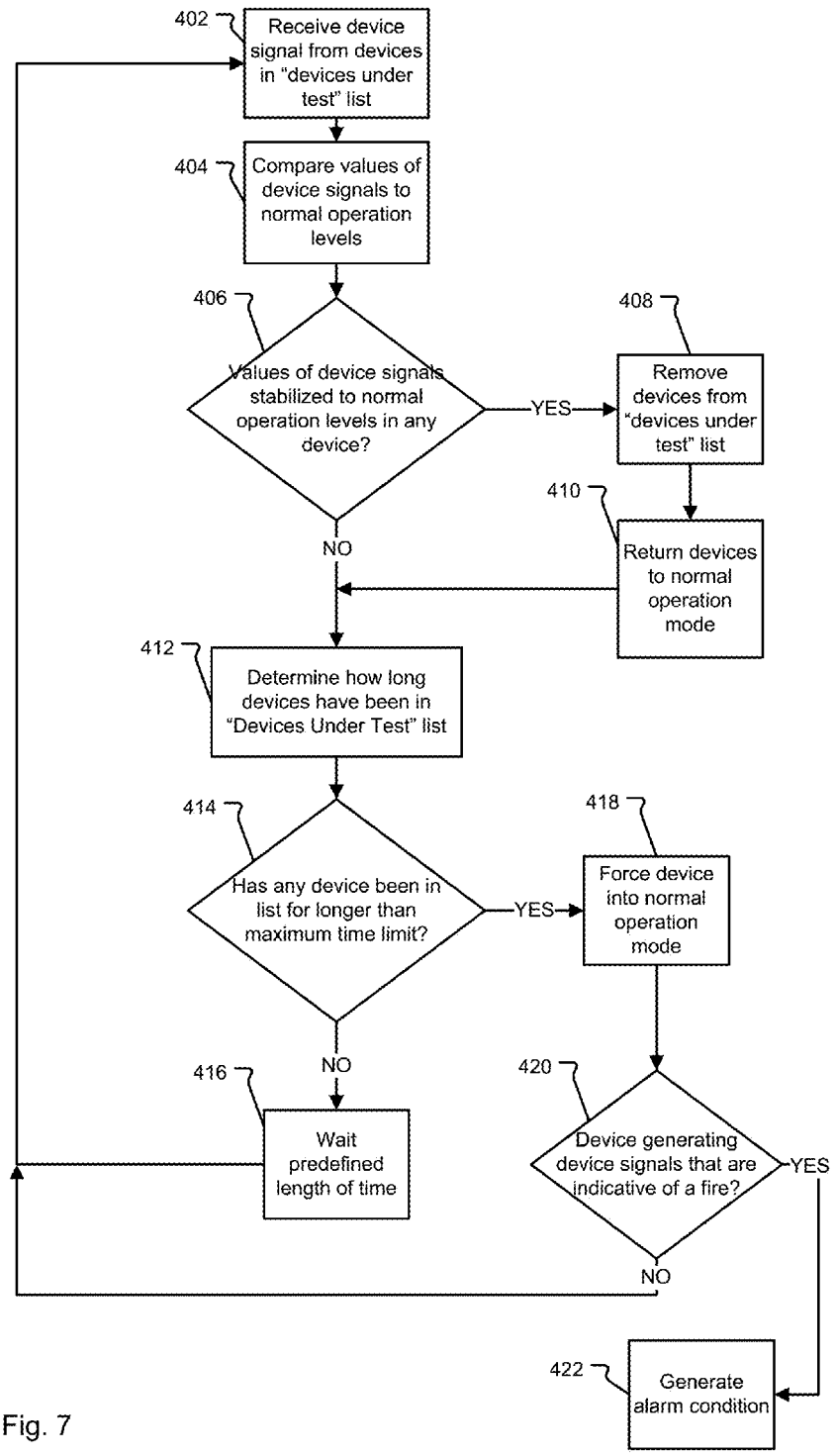
FIG. 7 is a flowchart illustrating an alternative embodiment to "age" the alarm initiating devices out of test mode after values of the alarm initiating devices have stabilized to normal levels.

FIG. 7 is flowchart illustrating the steps performed by the control panel 102 to monitor device signals from the alarm initiating devices and remove the devices from test mode after the analog values of the device signals (e.g., temperature, levels of smoke) have stabilized to normal operation levels. That is, the device signals have returned to levels that are no longer indicative of a fire.

In general, the control panel 102 monitors the analog values from the devices and removes the alarm initiating device out of the test mode when the analog values have stabilized to normal operation levels. This prevents the alarm initiating devices from returning to normal operation mode before the artificial smoke has flowed out of detection chambers of the smoke detectors and initiating a false alarm, for example.

Additionally, the control panel 102 implements a maximum time limit (or default to alarm) that restricts the length of time the alarm initiating devices are permitted to remain disabled and in test mode. This ensures that devices are not able to remain in test mode indefinitely. The maximum time limit protects against scenarios in which a fire occurs while the device is in test mode. In one scenario, real smoke from the fire could enter the smoke detector before the artificial smoke from test was able to flow out.

Thus, upon exceeding the maximum time limit, the alarm initiating devices are "forced" to return to normal operation mode. If the analog values of the device signals have not stabilized to normal, sub-alarm threshold values, an alarm condition is generated by the control panel 102. Alternatively, if the values have only partially returned to normal, a maintenance event could be triggered and the devices is placed in a Disabled state and trouble condition is initiated.

In the first step 402, the control panel 102 receives a device signal from the alarm initiating devices 109-1 to **109-*n* that are on devices under test list. The control panel 102 compares the values of the received device signals to normal operation levels in step 404. Next, in step 406, the control panel 102** determines if the values of the device signals have stabilized to normal operation levels in any of the devices.

If the values of the device signals have stabilized to normal operation levels, then the control panel 102 removes those alarm initiating devices from the devices under test list in step 408 and returns the devices to normal operation mode in step 410. If the values of the device signals have not stabilized to normal operation levels, then the control panel 102 determines how long the devices have been on the devices under test list in step 412.

In the next step 414, the control panel 102 determines if any device has been on the devices under test list for longer than the maximum time limit. If no devices have been in the list longer than the maximum time limit, then the control panel 102 waits a predetermined length of time in step 416. In one example, the predetermined wait time is five minutes. However, the predetermined wait time could be longer or shorter in other embodiments.

If any device has been in the devices under test list longer than the maximum time limit, then the control panel 102 forces that device into normal operation mode in step 418. In the next step 420, the control panel 102 determines if the devices are generating device signals that are indicative of a fire. If the devices are not generating device signals that are indicative of a fire, then the control panel 102 returns to step 402. If the devices are generating device signals that are indicative of a fire, then the control panel 102 generates an alarm condition in step 422.

While this invention has been particularly shown and described with references to preferred embodiments thereof, it will be understood by those skilled in the art that various changes in form and details may be made therein without departing from the scope of the invention encompassed by the appended claims.

What is claimed is:

1. A fire alarm system comprising:

alarm initiating devices for initiating fire alarms, each of the devices having an inspector-activated mechanism and generating and sending a test mode signal in response to activation of the inspector-activated mechanism; and a control panel that receives device signals from the alarm initiating devices and initiates fire alarm conditions based on the device signals, wherein the control panel places the alarm initiating devices into a test mode in response to receipt of the test mode signal from the alarm initiating devices for which the inspector-activated mechanisms have been activated, the control panel not initiating a fire alarm condition when the device signals are indicative of a fire if the device signals were from alarm initiating devices in the test mode.

2. The system according to claim 1, wherein the control panel returns the alarm initiating devices from the test mode to a normal operation mode in response the device signals no longer being indicative of a fire.

3. The system according to claim 1, wherein the control panel forces the alarm initiating devices to return from the test mode to the normal operation mode after a predefined length of time.

4. The system according to claim 1, wherein the alarm initiating devices provide visual and/or audible indications that the alarm initiating devices have been placed into the test mode by the control panel after the inspector-activated mechanisms are activated.

5. The system according to claim 1, wherein the control panel generates event data in response to the received device signals, the event data including addresses of the alarm initiating devices in the fire alarm system, dates and times of the activations of the alarm initiating devices, and/or fault states of the alarm initiating devices.

6. The system according to claim 1, wherein the inspector-activated mechanisms are magnetic switches of the alarm initiating devices.

7. The system according to claim 1, wherein the alarm initiating devices include smoke detectors, carbon monoxide detectors, temperature sensors, and/or pull stations.

8. The system according to claim 1, wherein the control panel determines if the devices are generating device signals indicative of a fire upon returning to a normal operation mode and the control panel initiating a fire alarm condition if the device signals are indicative of a fire.

9. A method of operation of a control panel of a fire alarm system, the method comprising:

receiving device signals from alarm initiating devices and test mode signals from alarm initiating devices in which inspector-activated mechanisms were activated;

the control panel placing the alarm initiating devices into a test mode in response to receiving test mode signals indicating that the inspector-activated mechanisms were activated; and the control panel not initiating a fire alarm condition when the device signals are indicative of a fire if the device signals were from alarm initiating devices in the test mode and the control panel initiating a fire alarm condition when the device signals are indicative of a fire if the device signals were from alarm initiating devices in a normal operation mode.

10. The method according to claim 9, further comprising the control panel returning the alarm initiating devices to the normal operation mode in response to the device signals no longer being indicative of a fire.

11. The method according to claim 9, further comprising the control panel returning the alarm initiating devices to the normal operation mode after a predefined length of time.

12. The method according to claim 9, further comprising the control panel causing the alarm initiating devices to provide visual and/or audible indications that the alarm initiating devices have been placed into the test mode.

13. The method according to claim 9, further comprising the control panel generating event data in response to the received device signals, the event data including addresses of the alarm initiating devices in the fire alarm system, dates and times of the activations of the alarm initiating devices, and/or fault states of the alarm initiating devices.

14. The method according to claim 9, further comprising an inspector magnetically activating the inspector-activated mechanisms of the alarm initiating devices.

15. The method according to claim 9, wherein the alarm initiating devices include smoke detectors, carbon monoxide detectors, temperature sensors, and/or pull stations.

16. The method according to claim 9, further comprising the control panel determining if the devices are generating device signals that are indicative of a fire upon returning to normal operation mode, the control panel initiating a fire alarm condition if the device signals are indicative of a fire.

17. A method of operation of alarm initiating devices, the method comprising:

activating inspector-activated mechanisms of the alarm initiating devices to signal a control panel that a test is to be performed;

the alarm initiating devices in which the inspector-activated mechanisms have been activated generating and sending test mode signals in response to activation of the inspector-activated mechanism;

activating the alarm initiating devices to generate device signals, which are sent to the control panel; and the control panel automatically returning the alarm initiating devices to a normal operation mode after receiving the test mode signals.

18. The method according to claim 17, further comprising the control panel automatically returning the alarm initiating devices to the normal operation mode in response to the device signals no longer being indicative of a fire.

19. The method according to claim 17, further comprising the control panel returning the alarm initiating devices to the normal operation mode after a predefined length of time.

20. The method according to claim 9, further comprising the control panel causing the alarm initiating devices to provide visual and/or audible indications that the alarm initiating devices have been placed into the test mode.

21. The method according to claim 9, further comprising an inspector magnetically activating the inspector-activated mechanisms of the alarm initiating devices.

22. A fire alarm system comprising:

alarm initiating devices for initiating fire alarms, each of the devices having an inspector-activated mechanism and generating and sending a test mode signal in response to activation of the inspector-activated mechanism; and a control panel that receives device signals from the alarm initiating devices and initiates fire alarm conditions based on the device signals, wherein the control panel places the alarm initiating devices into a test mode in response to receipt of the test mode signal from the alarm initiating devices for which the inspector-activated mechanisms have been activated, the control panel not initiating a fire alarm condition when the device signals are indicative of a fire if the device signals were from alarm initiating devices in the test mode, the control panel automatically returning the alarm initiating devices to a normal operation mode.

23. The system according to claim 1, wherein the control panel leaves other alarm initiating devices connected to the control panel in a normal operation mode.

24. The method according to claim 9, further comprising the control panel returning the alarm initiating devices to the normal operation mode in response to the device signals no longer being indicative of a fire.

25. The system according to claim 1, wherein an alarm initiating device sends a test mode signal to the control panel in response to activation of the inspector-activated mechanism of the alarm initiating device, in response, the control panel logs a device ID of the alarm initiating device.

26. The system according to claim 25, wherein the control panel causes a light emitter of the device to illuminate in a pattern to indicate that the alarm initiating device has been placed into test mode by the control panel.

* * * * *